United States Patent [19]

Pepping

[11] Patent Number: 4,803,600

[45] Date of Patent: Feb. 7, 1989

[54] LUMINAIRE FOR A ROD-SHAPED FLUORESCENT LAMP

[75] Inventor: Franz Pepping, Pulheim, Fed. Rep. of Germany

[73] Assignee: U.S. Philips Corporation, New York, N.Y.

[21] Appl. No.: 143,896

[22] Filed: Jan. 14, 1988

[30] Foreign Application Priority Data

Mar. 18, 1987 [DE] Fed. Rep. of Germany ..... 3708762

[51] Int. Cl.[4] ..... F21S 3/00

[52] U.S. Cl. ..... 362/217; 362/260; 439/236

[58] Field of Search ..... 362/217, 226, 260; 439/236, 237, 239

[56] References Cited

U.S. PATENT DOCUMENTS 4,298,918 11/1981 Metcalf, II ..... 362/217

*Primary Examiner*—Stephen F. Husar

[57] ABSTRACT

A luminaire for a rod-shaped fluorescent lamp provided with pin bases at both ends and having an elongated support profile whose width is only slightly larger or smaller than the diameter of the lamp envelope and which at both ends has sockets provided with contacts. Each socket has a groove to accommodate the base pins when inserting the lamp in an axially parallel manner. Intermediate members of an insulating material are arranged on the lamp bases, while the rear side of each intermediate member is provided with a cross limb extending parallel to the base pins and being formed in such a manner that the individual base pins are located on different sides of the cross limb. When inserting the lamp in the luminaire, the intermediate member engages the groove of a socket in a lock-tight manner, whereby the base pins come into contact with the socket contacts.

16 Claims, 3 Drawing Sheets

LUMINAIRE FOR A ROD-SHAPED FLUORESCENT LAMP

BACKGROUND OF THE INVENTION

The invention relates to a luminaire for a rod-shaped fluorescent lamp provided with pin bases at both ends and having an elongated support profile whose width is only slightly larger or smaller than the diameter of the lamp envelope and which at both ends has contact-provided sockets each having a groove to accommodate the base pins when inserting the lamp in an axially parallel manner.

Luminaires of this type are conventionally provided with sockets in which the lamp is inserted with its base pins in an axially parallel manner after which the base pins are locked and contacted with the socket contacts by means of a quarter turn of the lamp about its longitudinal axis. However, if for constructional reasons the luminaire should be very narrow, i.e., if its width should be only slightly larger or even smaller than the diameter of the lamp envelope, commercially available lamp sockets can no longer be used because they cannot be manufactured with such small dimensions.

A luminaire for a rod-shaped fluorescent lamp having an elongated support profile whose width is of the order of the lamp envelope is known from EP-PS 12234. For inserting or exchanging the lamp the sockets are arranged to move in the axial direction with respect to the support profile, that is to say the sockets can be axially moved outwards from their normal operating position into a locked position such that the fluorescent lamp can be inserted or removed without any further measures. Independently of the fact that a relatively cumbersome construction is used in this case, the known luminaire requires a large space in the longitudinal direction. Then a stroke of non-interrupted light is impossible.

SUMMARY OF THE INVENTION

The invention has therefore for its object to provide a low cost luminaire with a narrow support profile in which the sockets remain in a fixed position with respect to the support profile when the lamp is inserted in these sockets in an axially parallel manner.

According to the invention, in a luminaire of the type described in the opening paragraph this object is realized in that intermediate members of an insulating material are arranged on the lamp bases, the rear side of each member being provided with a cross limb extending parallel to the base pins and being formed in such a manner that the individual base pins are located on different sides of the cross limb which, when inserting the lamp in the luminaire, engages the groove of a socket in a lock-tight manner whereby the base pins come into contact with the socket contacts.

In this case the lamp is locked in the sockets by means of the intermediate members arranged on the lamp bases without having to move these sockets in the axial direction with respect to the support profile. The length of the luminaire is thus not changed when exchanging the lamp. The arrangement of the individual base pins of the lamps on different sides of the cross limb of the intermediate members fulfills the safety requirements prescribing that neither one of the two base pins may be touched when the other pin is already in electrical contact with one of the socket contacts. For this purpose the cross limb is preferably S-shaped in its cross-section.

For a better locking of the intermediate members in the sockets the upper edge of the cross limb of the intermediate members may have a widening which locks in a lid-type relationship with the groove in the socket.

To eliminate the possibility of contacting one of the base pins when improperly handling the lamp, for example, when trying to insert the lamp without intermediate members into the sockets, an advantageous embodiment of the luminaire according to the invention is characterized in that for inserting the two base pins each intermediate member has two contact sleeves which have lengths projecting beyond the base pins and which mate with the socket contacts accommodated in the socket at a corresponding depth. The socket contacts are accommodated in the sockets at such a depth that the relatively short base pins of the lamp cannot reach the socket contacts when a lamp is inserted without intermediate members.

In order to cover the two lamp bases completely, a further advantageous embodiment of the luminaire according to the invention is characterized in that each intermediate member is formed with a cylindrical sleeve on its front side accommodating the lamp base.

BRIEF DESCRIPTION OF THE DRAWINGS

The invention will now be described in greater detail by way of example with reference to the accompanying drawing in which.

DESCRIPTION OF THE PREFERRED EMBODIMENT

Figure 1:
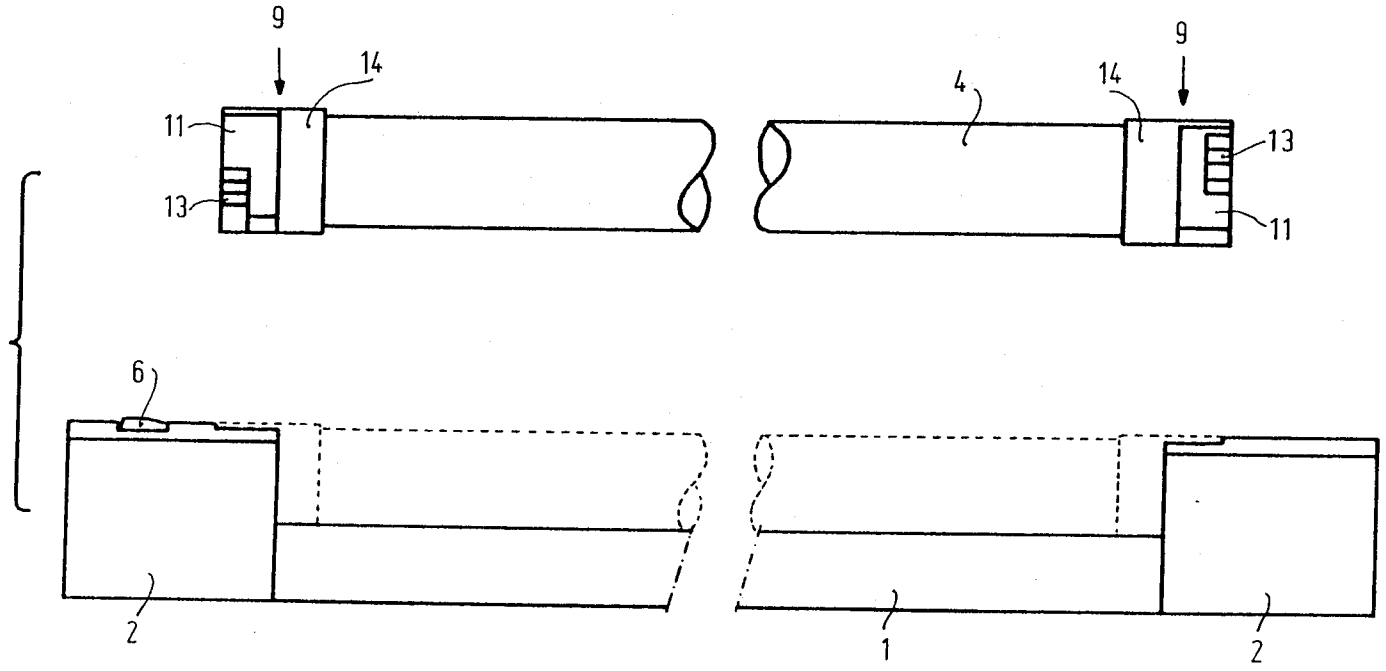
FIG. 1 is a side elevation of a luminaire with a fluorescent lamp arranged in an axially parallel manner whose bases have intermediate members arranged on them.
Figure 2:
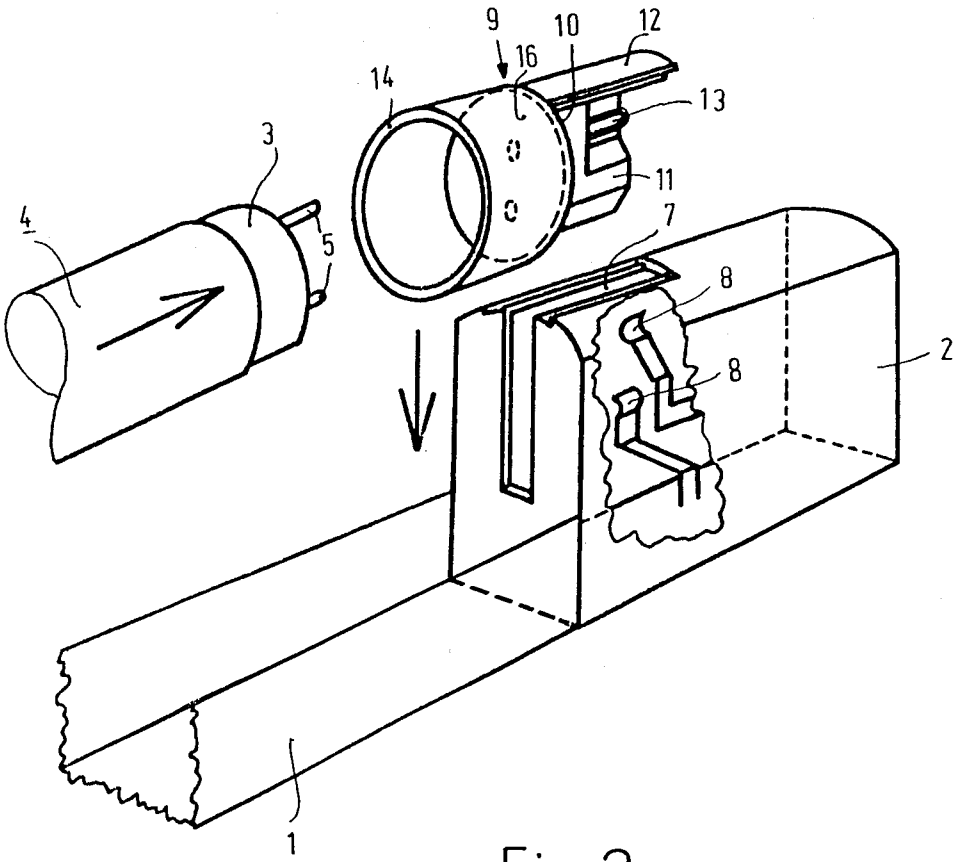
FIG. 2 is a perspective view of a socket (partly in a cross-section) with an intermediate member which can be arranged on a fluorescent lamp before it is inserted in the socket.

The luminaire shown in FIG. 1 has an elongated trough-shaped support profile 1 provided with sockets 2 of, for example an insulating material at both ends. The luminaire is used for accommodating a rod-shaped fluorescent lamp 4 provided with pin bases 3 at both ends (compare FIG. 2). The two pin bases 3 of the fluorescent lamp 4 each have two base pins 5. The support profile 1, whose width is only slightly larger or smaller than the diameter of the glass envelope of the lamp 4, may accommodate the ballasts required for operating the fluorescent lamp 4 such as the choke, the starter and possibly a temperature fuse (not shown). If the lamp 4 is operated with an electronic ballast, it can be built in one of the sockets 2. One of the sockets 2 accommodates an electric switch 6 for switching the lamp 4 on and off. As is shown in FIG. 2, each socket 2 has a groove 7 to accommodate the base pins 5 and intermediate member 6. Socket contacts 8 which are arranged one above the other are provided in the sockets 2.

Figure 3:
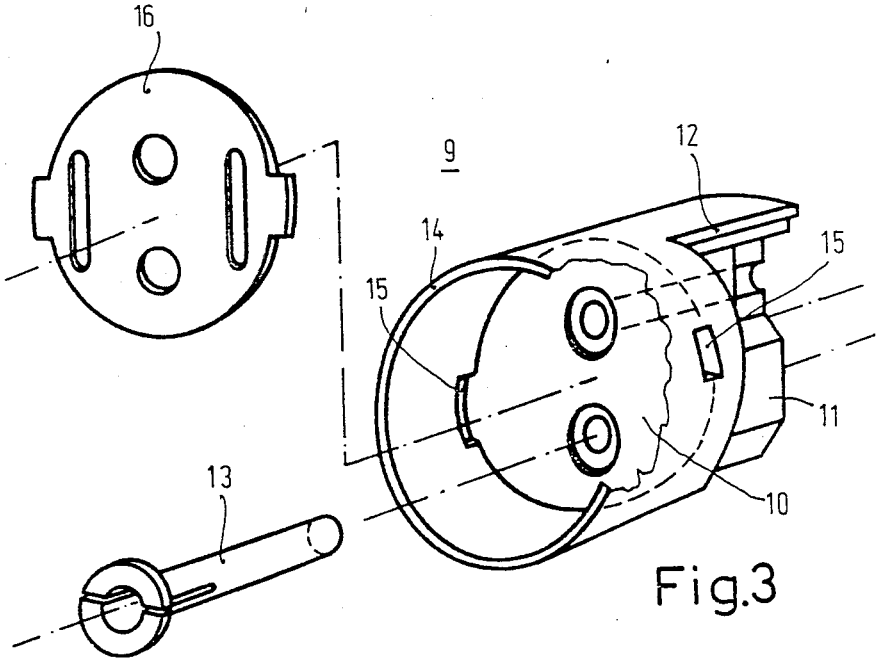
FIG. 3 is a perspective exploded view of an intermediate member.
Figure 4:
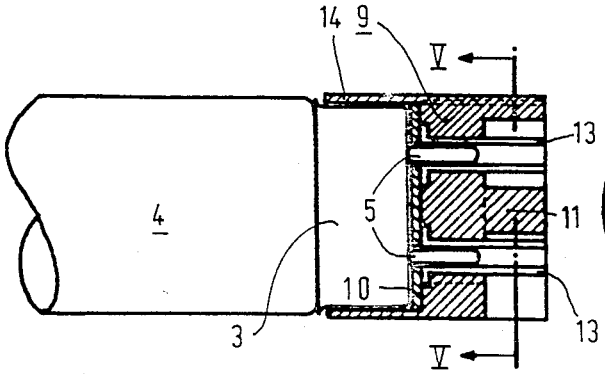
FIG. 4 is a longitudinal section through an intermediate member arranged on a fluorescent lamp.
Figure 5:
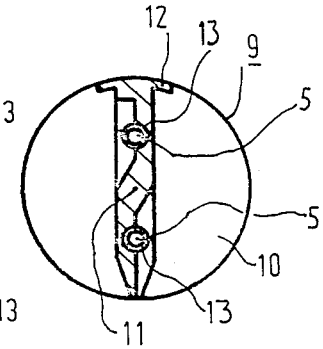
FIG. 5 is a cross-section through said intermediate member, taken on the line V—V in FIG. 4.

Intermediate members 9 of an insulating material, which are shown in greater detail in FIGS. 3 to 5, are arranged on the lamp bases 3. These intermediate members 9 consist of a disc-shaped synthetic material portion 10 whose rear side is provided with a cross limb 11 extending parallel to the base pins 5 and being S-shaped in its cross-section (FIG. 5). When inserting the lamp 4 provided with the intermediate members 9 into the luminaire in the direction of the arrow, the cross limbs 11 penetrate the grooves 7 of the sockets 2. The upper edge of each cross limb 11 has a widening 12 which locks in a lid-type relationship with the groove 7 in the wall of a socket 2 so that the lamp 4 is locked in the luminaire.

As is shown in FIG. 3, each intermediate member 9 has two longitudinally grooved contact sleeves 13 for the purpose of inserting the two base pins 5 of the lamp 4, which sleeves are considerably longer than the base pins 5 and extend on different sides of the cross limb 11 (FIG. 5).

Each intermediate member 9 is formed with a cylindrical sleeve 14 on its front side, accommodating the lamp base 3. Two slotted recesses 15 for accommodating an insulating cover 16 (FIG. 3) are provided at the base of the cylindrical sleeve 14.

As is particularly evident from FIGS. 1 and 4, the intermediate members 9 are arranged on the lamp bases 3 which are covered by the cylindrical sleeve 14. The base pins 5 of the lamp 4 penetrate the contact sleeves 13 while forming a large contact face. The lamp 4 with the intermediate members 9 arranged on it is then moved in an axially parallel manner towards the support profile 1 in the direction of the arrow whereby the intermediate members 9 with their cross limbs 11 penetrate the grooves 7 of the sockets 2 until the widenings 12 of the cross limbs 11 lock with the walls of the sockets 2 in a lid-type relationship with the grooves 7. The two contact sleeves 13 which have lengths projecting beyond the base pins 5 then come into contact with the socket contacts 8 deep in the socket 2. More specifically, the lower contact sleeve in FIG. 2 comes into contact with the lower socket contact and the upper contact sleeve comes into contact with the upper socket contact. This results in an electric connection between the socket contacts 8 via the contact sleeves 13 and the base pins 5 of the lamp 4. As is particularly shown in FIG. 5, the two contact sleeves 13 are arranged on different sides of the cross limb 11 so that each contact sleeve 13 can only come into electrical contact with the appropriate socket contact 8 when the lamp 4 is inserted in the sockets 2. Thus the two contact sleeves 13 simultaneously come into contact with their socket contacts 8 so that the contacts cannot be touched from the exterior. The reverse order is used when removing or exchanging the lamp 4.

What is claimed is:

1. A luminaire for a rod-shaped fluorescent lamp provided with pin bases at both ends and having an elongated support profile whose width is only slightly larger or smaller than the diameter of the lamp envelope and which at both ends has sockets provided with contacts each having a groove to accommodate the base pins when inserting the lamp in an axially parallel manner, characterized in that intermediate members of an insulating material are arranged on the lamp bases, the rear side of each member being provided with a cross limb extending parallel to the base pins and being formed in such a manner that the individual base pins are located on different sides of the cross limb which, when inserting the lamp in the luminaire, engages the groove of a socket in a lock-tight manner, whereby the base pins come into contact with the socket contacts.

2. A luminaire as claimed in claim 1, characterized in that the upper edge of the cross limb has a widening which locks in a lid-type relationship with the groove in the socket.

3. A luminaire as claimed in claim 2, characterized in that the cross limb is S-shaped in its cross section.

4. A luminaire as claimed in claim 3, characterized in that for inserting the two base pins each intermediate member has two contact sleeves which have lengths projecting beyond the base pins and which mate with the socket contacts accommodated in the socket at a corresponding depth.

5. A luminaire as claimed in claim 4, characterized in that each intermediate member is formed with a cylindrical sleeve on its front side, accommodating the lamp base.

6. A luminaire as claimed in claim 3, characterized in that each intermediate member is formed with a cylindrical sleeve on its front side, accommodating the lamp base.

7. A luminaire as claimed in claim 2, characterized in that each intermediate member is formed with a cylindrical sleeve on its front side, accommodating the lamp base.

8. A luminaire as claimed in claim 2, characterized in that for inserting the two base pins each intermediate member has two contact sleeves which have lengths projecting beyond the base pins and which mate with the socket contacts accommodated in the socket at a corresponding depth.

9. A luminaire as claimed in claim 8, characterized in that each intermediate member is formed with a cylindrical sleeve on its front side, accommodating the lamp base.

10. A luminaire as claimed in claim 1, characterized in that the cross limb is S-shaped in its cross section.

11. A luminaire as claimed in claim 10, characterized in that for inserting the two base pins each intermediate member has two contact sleeves which have lengths projecting beyond the base pins and which mate with the socket contacts accommodated in the socket at a corresponding depth.

12. A luminaire as claimed in claim 11, characterized in that each intermediate member is formed with a cylindrical sleeve on its front side, accommodating the lamp base.

13. A luminaire as claimed in claim 10, characterized in that each intermediate member is formed with a cylindrical sleeve on its front side, accommodating the lamp base.

14. A luminaire as claimed in claim 1, characterized in that for inserting the two base pins each intermediate member has two contact sleeves which have lengths projecting beyond the base pins and which mate with the socket contacts accommodated in the socket at a corresponding depth.

15. A luminaire as claimed in claim 14, characterized in that each intermediate member is formed with a cylindrical sleeve on its front side, accommodating the lamp base.

16. A luminaire as claimed in claim 1, characterized in that each intermediate member is formed with a cylindrical sleeve on its front side, accommodating the lamp base.

* * * * *